US009039109B2

(12) United States Patent
Salice

(10) Patent No.: US 9,039,109 B2
(45) Date of Patent: May 26, 2015

(54) PULL-OUT GUIDE ASSEMBLY FOR A DRAWER

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 14/006,660

(22) PCT Filed: May 10, 2012

(86) PCT No.: PCT/EP2012/058698

§ 371 (c)(1),
(2), (4) Date: Sep. 20, 2013

(87) PCT Pub. No.: WO2012/152893

PCT Pub. Date: Nov. 15, 2012

(65) Prior Publication Data

US 2014/0009054 A1 Jan. 9, 2014

(30) Foreign Application Priority Data

May 12, 2011 (IT) ..... MI2011A0834

(51) Int. Cl.

*A47B 88/16* (2006.01)
*A47B 88/04* (2006.01)
*A47B 88/10* (2006.01)

(52) U.S. Cl.

CPC ..... *A47B 88/16* (2013.01); *A47B 88/10* (2013.01); *A47B 2210/0032* (2013.01); *A47B 88/04* (2013.01); *A47B 2210/0081* (2013.01); *A47B 2210/0097* (2013.01)

(58) Field of Classification Search

CPC ..... A47B 88/10; A47B 88/14; A47B 2210/0032; A47B 2210/0097; A47B 2210/0059; A47B 2210/0037; A47B 88/16; A47B 88/04; A47B 2210/0081

USPC ..... 312/333, 334.44–334.47, 334.6, 334.1, 312/334.7–334.18; 384/18–20

See application file for complete search history.

(56) References Cited

U.S. PATENT DOCUMENTS 6,015,199 A * 1/2000 Netzer et al. ..... 312/334.8
6,220,683 B1 * 4/2001 Chu ..... 312/334.44

(Continued)

FOREIGN PATENT DOCUMENTS

EP 0868866 A2 10/1998
GB 2449915 A 12/2008
WO 2004100710 A2 11/2004

OTHER PUBLICATIONS

International Search Report, PCT/EP2012/058698 mailed Dec. 11, 2012 (3 pgs.).

*Primary Examiner* — Daniel J Troy
*Assistant Examiner* — Hiwot Tefera
(74) *Attorney, Agent, or Firm* — Blank Rome LLP

(57) ABSTRACT

A pull-out guide assembly for a drawer, comprising a first guide part (2) and at least a second guide part (3) relatively and reversibly slidable in the pull-out direction of the drawer, at least one carriage (4) interposed between the first and second guide part (2, 3) and reversibly slidable in the pull-out direction of the drawer, the carriage (4) having a plurality of housing seats (8) for load-transmitting rolling elements (9) and at its ends elastically yielding stops (23, 23') suitable for interacting with arrest elements (30, 31) provided on the first and second guide parts (2, 3) in order to the limit the relative sliding thereof, characterized in that each of said stops (23, 23') is a component separate from the carriage (4) and has means of anchorage to the carriage (4), each stop (23, 23') being a component separate from the carriage (4) and having means of anchorage to the carriage (4) comprising an anchorage element (28, 28') insertable by means of mating shapes or by force or snap fitting into at least one of the housing seats (8) already present on said carriage (4) for the rolling elements (9).

19 Claims, 2 Drawing Sheets

(56) References Cited

U.S. PATENT DOCUMENTS

| | | | | |
|---|---|---|---|---|
| 6,382,751 | B1 * | 5/2002 | Chiu | 312/334.11 |
| 7,396,092 | B2 * | 7/2008 | Prentner et al. | 312/334.6 |
| 7,762,637 | B2 * | 7/2010 | Lam et al. | 312/334.6 |
| 8,277,003 | B2 * | 10/2012 | Milligan et al. | 312/334.6 |
| 8,474,926 | B2 * | 7/2013 | Prentner | 312/334.16 |
| 8,690,270 | B2 * | 4/2014 | Hammerle et al. | 312/334.13 |
| 2003/0222556 | A1 | 12/2003 | Larsen | |
| 2004/0000851 | A1 * | 1/2004 | Lam Harn et al. | 312/334.7 |
| 2004/0227280 | A1 | 11/2004 | Booker et al. | |
| 2004/0227440 | A1 | 11/2004 | Booker et al. | |
| 2004/0227444 | A1 * | 11/2004 | Booker et al. | 312/334.45 |
| 2005/0174021 | A1 * | 8/2005 | Blum et al. | 312/334.13 |
| 2005/0231083 | A1 * | 10/2005 | Garcie | 312/333 |
| 2006/0049732 | A1 * | 3/2006 | Prentner et al. | 312/334.1 |
| 2008/0303395 | A1 * | 12/2008 | Chen et al. | 312/334.8 |
| 2009/0238503 | A1 * | 9/2009 | Liang et al. | 384/18 |
| 2010/0045153 | A1 * | 2/2010 | Ritter | 312/334.1 |
| 2012/0049712 | A1 * | 3/2012 | Lobbezoo | 312/334.12 |

* cited by examiner

PULL-OUT GUIDE ASSEMBLY FOR A DRAWER

CROSS REFERENCE TO RELATED APPLICATIONS

This application is a U.S. national phase application of International No. PCT/EP2012/058698, filed May. 10, 2012, designating the United States, which claims benefit from Italy Application No. MI2011A 000834, filed May 12, 2011, both of which are hereby incorporated herein by reference in their entirety.

FIELD

Background

The present invention relates to a pull-out guide assembly for a drawer.

The use of pull-out guides for drawers, of the type comprising, on each side of the drawer, a fixed guide part connectable to the body of a piece of furniture, a mobile guide part fixable to a drawer, and an optional intermediate guide part sliding between the fixed and mobile guide parts, is well known.

Between said guide parts there is disposed at least one sliding carriage which has a plurality of housing seats for load-transmitting rolling elements, for example in the form of rollers or balls.

In order to limit the movement of the drawer, the guide parts are provided with suitable arrest elements, against which the ends of the carriage come into contact in the completely pulled out and completely closed positions of the drawer itself When, however, the carriages come into contact with the arrest elements, there occur impacts such as to generate problems of noise and of mechanical resistance of the carriages.

In order to overcome such drawbacks, the carriages can be advantageously provided on each end with an elastically yielding stop capable of absorbing the kinetic energy of the carriages, so as to dampen the impacts deriving from contact with the arrest elements of the guide parts.

Said elastically yielding stops can be formed as separate parts to be applied to the carriages; however, in this case it is necessary to make changes to the form of the carriages, to the extent compatible with their dimensional and constructive characteristics, in order to realize specific seats and provide specific means on the carriage for anchoring the stops.

Alternatively, the elastically yielding stops can be formed in a single piece with the carriages, but this entails a greater complexity in the forming of the carriage and the need to make different dies for carriages provided with stops and carriages without stops.

In such a case, moreover, should the elastic stops break, it would be necessary to replace the entire carriage.

SUMMARY

The technical task that the present invention has set itself is therefore to realize a pull-out guide assembly for a drawer, wherein there is provided at least one carriage with elastically yielding stops at its ends, and which enables the technical disadvantages complained of in the prior art to be eliminated.

Within the scope of this technical task, one object of the invention is to realize a pull-out guide assembly for a drawer, wherein there is provided at least one carriage with elastically yielding stops at its ends, which enables the stops to be anchored to the carriage without there being any need to substantially modify the form of the carriage, and which moreover enables envisioning a single base die for the realization of a carriage in which it is possible to choose whether or not to mount the stops.

Another object of the invention is to realize a pull-out guide assembly for a drawer, wherein there is provided at least one carriage with elastically yielding stops at its ends, and wherein envisaging stops does not complicate the forming of the carriage.

Another object of the invention is to realize a pull-out guide assembly for a drawer, wherein there is provided at least one carriage with elastically yielding stops at its ends, which assures a considerable simplicity of mounting and replacing the stops, and which makes it possible to use the stops themselves on different carriages.

The technical task, as well as these and other objects, are achieved according to the present invention by realizing a pull-out guide assembly for a drawer, comprising a first guide part and at least a second guide part relatively and reversibly slidable in the pull-out direction of the drawer, and at least one carriage interposed between said first and second guide parts and reversibly slidable in the pull-out direction of the drawer, said carriage having a plurality of housing seats for load-transmitting rolling elements and at its ends elastically yielding stops suitable for interacting with arrest elements provided on said first and second guide parts in order to the limit the relative sliding thereof, characterized in that each of said stops is a component separate from the carriage and has means of anchorage to the carriage comprising an anchorage element insertable by means of mating shapes or by force or snap fitting into at least one of the housing seats already present on said carriage for the rolling elements.

For the anchorage of the elastically yielding stops, the pull-out guide assembly for a drawer according to the invention exploits the housing seats of the load-transmitting rolling elements already commonly present on a carriage of a known type.

One of the salient aspects of the invention is thus that a commonly available carriage can be fitted with the elastically yielding stops without the need for any specific processes.

At the time of assembly, the operator can therefore decide, also based on the specific application, whether or not to apply the elastically yielding stops to the carriage.

The anchorage of the stops, which can be realized, for example, by means of mating shapes or by force or snap fitting, assures a considerable simplicity of assembly and the possibility of replacing the stops themselves.

Other characteristics of the present invention are moreover defined in the subsequent claims.

BRIEF DESCRIPTION OF THE DRAWINGS

Further characteristics and advantages of the invention will be more apparent from the description of a preferred, but not exclusive embodiment of the pull-out guide assembly for a drawer according to the invention, illustrated by way of non-restrictive example in the appended drawings, in which.

DETAILED DESCRIPTION

Figure 1:
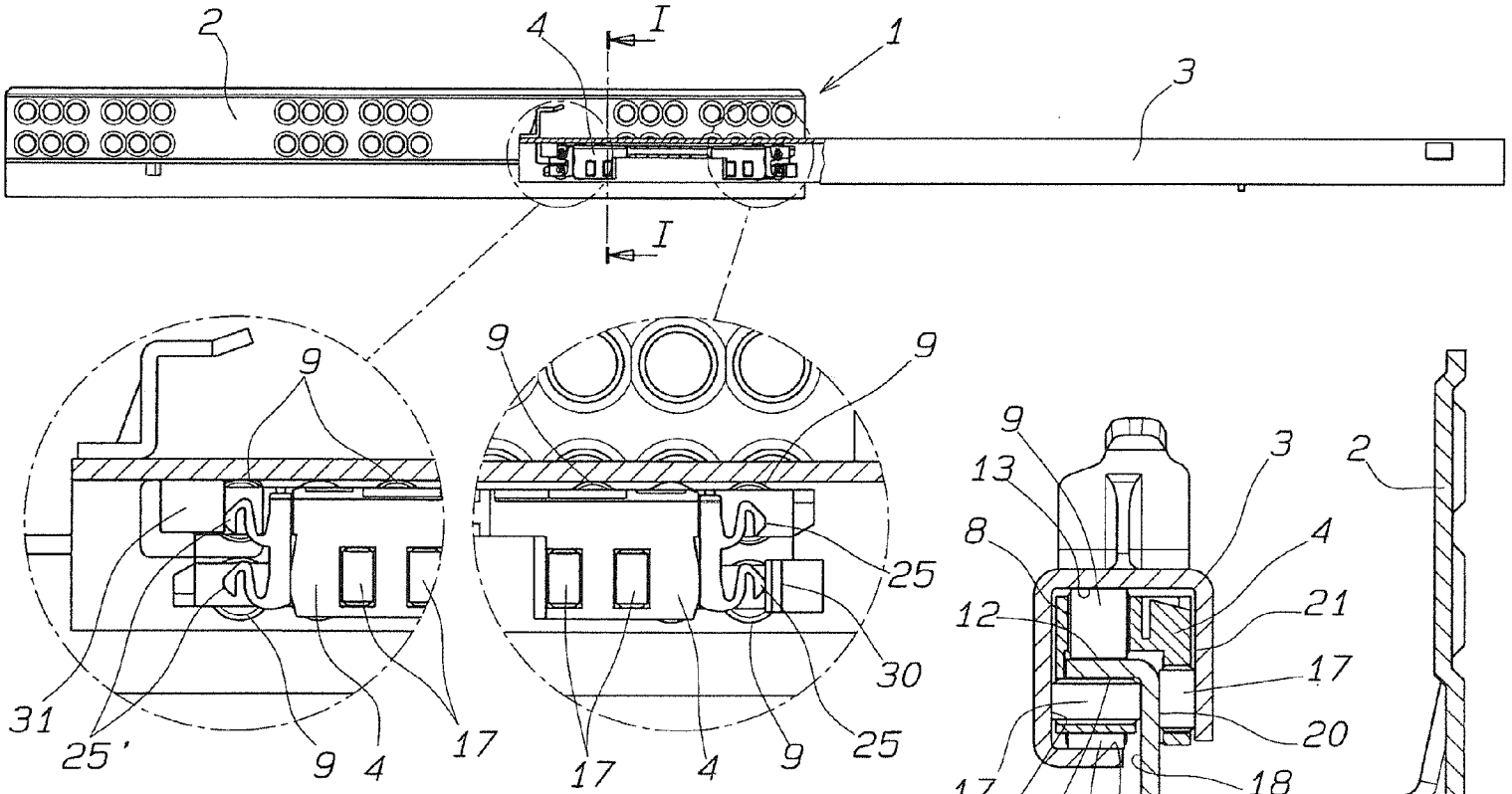
FIG. 1 shows a partially sectional view of the pull-out guide assembly for a drawer in the completely pulled-out position, with enlarged details relating to the ends of the carriage provided with elastically yielding stops.
Figure 2:
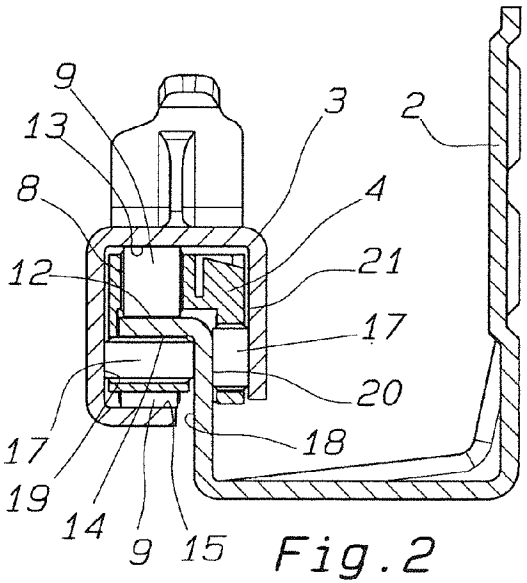
FIG. 2 shows an enlarged cross section of the pull-out guide assembly of FIG. 1, along the line I-I.
Figure 3:
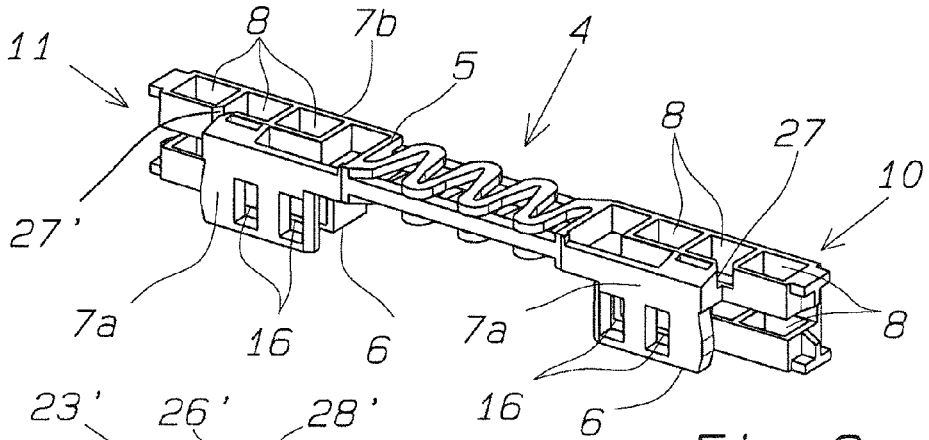
FIG. 3 shows an axonometric view of the carriage prior to assembly of the load-transmitting rolling elements and elastically yielding stops.

With reference to the aforesaid figures, there is shown a pull-out guide assembly for a drawer indicated overall with the reference number 1.

The pull-out guide assembly comprises a first guide part 2 and at least a second guide part 3 relatively and reversibly slidable in the pull-out direction of the drawer.

In particular, the first guide part 2 is fixed, being fixed to the body of a piece of furniture in which the drawer slides, whereas the second guide part 3 is movable, being directly fixed to the drawer.

Interposed between the first guide part 2 and the second guide part 3, there is at least one carriage 4, which is likewise reversibly slidable in the pull-out direction of the drawer.

Optionally, in a solution that is not shown, it is also possible to provide an intermediate guide part sliding between the first guide part 2 and the second guide part 3, and in such a case there will be provided at least one carriage 4 between the first guide 2 and the intermediate guide part and at least one carriage 4 between the second guide part 3 and the intermediate guide part.

The carriage 4 has an upper delimiting wall 5, a lower delimiting wall 6, oriented parallel to the upper one and flat outer laterally delimiting walls 7*a*, 7*b* and extends along a longitudinal axis of extension in the pull-out direction of the drawer.

The carriage 4 has a plurality of housing seats 8 for load-transmitting rolling elements 9, represented in this case by rollers, which can alternatively be replaced by balls.

A first series of seats 8 aligned in sequence in the direction of the longitudinal axis of extension of the carriage 4 is obtained through the entire thickness of the upper delimiting wall 5, and a second series of seats 8 aligned in sequence in the direction of the longitudinal axis of extension of the carriage 4 is obtained through the entire thickness of the lower delimiting wall 6.

The seats 8 are distributed at the front end 10 and rear end 11 of the carriage 4.

The rolling elements 9 are engaged in the seats 8 in such a way as to be able to rotate around their axis, which is oriented horizontally and orthogonally to the pull-out direction of the drawer.

The rolling elements 9 of the first series have a diameter that is greater than the thickness of the delimiting wall 5, so that they protrude diametrically from both sides of the seats 8 in order to be able to roll without sliding friction on one side along a horizontal flat surface 12 of the first guide part 2 and on the other side along a horizontal flat surface 13 of the second guide part 3.

Analogously, the rolling elements 9 of the second series have a diameter that is greater than the thickness of the delimiting wall 6, so that they protrude diametrically from both sides of the seats 8 in order to be able to roll without sliding friction on one side along a horizontal flat surface 14 of the first guide part 2 and on the other side along a horizontal flat surface 15 of the second guide part 3.

The carriage 4 moreover has a plurality of housing seats 16 for rolling lateral guide elements 17, represented in this case by rollers, which can alternatively be replaced by balls.

A first series of seats 16 aligned in sequence in the direction of the longitudinal axis of extension of the carriage 4 is obtained through the entire thickness of the flat outer laterally delimiting wall 7*a*, and a second series of seats 16 aligned in sequence in the direction of the longitudinal axis of extension of the carriage 4 is obtained through the entire thickness of the flat outer laterally delimiting wall 7*b*.

The seats 16 are distributed at the front end 10 and rear end 11 of the carriage 4.

The rolling elements 17 are engaged in the seats 16 in such a way as to be able to rotate around their axis, which is oriented vertically and orthogonally to the pull-out direction of the drawer.

The rolling elements 17 of the first series have a diameter that is greater than the thickness of the lateral delimiting wall 7*a*, so that they protrude diametrically from both sides of the seats 16 in order to be able to roll without sliding friction on one side along a vertical flat surface 18 of the first guide part 2 and on the other side along a vertical flat surface 19 of the second guide part 3.

Analogously, the rolling elements 17 of the second series have a diameter that is greater than the thickness of the laterally delimiting wall 7*b*, so that they protrude diametrically from both sides of the seats 8 in order to be able to roll without sliding friction on one side along a vertical flat surface 20 of the first guide part 2 and on the other side along a vertical flat surface 21 of the second guide part 3.

Each end 10, 11 of the carriage 4 has a respective elastically yielding stop 23, 23' suitable for interacting with arrest elements provided on the first guide part 2 and on the second guide part 3 so as to limit the relative sliding thereof.

Each stop 23, 23' is advantageously a component separate from the carriage 4 and has respective means of anchorage to the carriage 4, configured to be insertable in at least one of the housing seats 8 for the rolling elements 9.

In the solution shown, each stop 23, 23' is anchorable to a respective housing seat 8.

Each stop 23, 23' comprises a respective support body 24, 24', which in the assembled position is positioned laterally to the seat 8 to which it is anchored.

The support body 24, 24' of each stop 23, 23' is essentially a parallelepiped oriented with its longitudinal axis orthogonal to the pull-out direction of the drawer.

The support body 24 of the stop 23 has at least one or, as shown, at least two elastically yielding tabs 25 at the front.

The support body 24' of the stop 23' has at least one or, as shown, at least two elastically yielding tabs 25' at the back.

The elastically yielding tabs 25 and respectively 25' of the stop 23 and respectively 23' are preferably formed in a single piece with the support body 24 and respectively 24'.

In the preferred embodiment described here, the two elastic tabs 25 and respectively 25' of the stop 23 and respectively 23' are positioned one on top of the other.

In this case, in the condition illustrated in FIG. 1, with the drawer completely pulled out, the lower tab 25 of the stop 23 comes into contact with a first stop element 30 formed on the first guide part 2, while the upper tab 25' of the stop 23' comes into contact with a first stop element 31 formed on the second guide part 3, whereas in the completely retracted condition (not illustrated) of the drawer the upper tab 25 of the stop 23 comes into contact with a second stop element (not shown) formed on the first guide part 2, while the lower tab 25' of the stop 23' comes into contact with a second stop element (not shown) formed on the second guide part 3.

In a preferred embodiment, not shown, the tabs 25 and respectively 25' of the stop 23 and respectively 23' can be positioned alongside each other.

The support body 24 and respectively 24' of the stop 23 and respectively 23' has at the side a bridge 26 and respectively 26' for connecting to the anchorage means.

In an assembled condition, the bridge 26 and respectively 26' preferably extend through an escape 27 and respectively 27' of a laterally delimiting wall of the seat 8 to which the stop 23 and respectively 23' are anchored.

The support body 24 and respectively 24' and the bridge 26 and respectively 26' of each stop 23 and respectively 23' are confined within extensions of the upper 5 and lower 6 delimiting walls of the carriage 4, and within extensions of the flat outer laterally delimiting walls 7*a*, 7*b* of the carriage 4.

The anchorage means of each stop 23 and respectively 23' comprise an anchorage element 28 and respectively 28', which, once inserted into its respective seat 8, protrudes from opposite sides of the seat 8 itself with surfaces having a curvature analogous to that of the load-transmitting rolling elements 9.

Each anchorage element 28, 28' protrudes from opposite sides of the seat 8 to the same degree as the rolling elements 9 protrude from the corresponding seats 8.

In the particular case considered, each anchorage element 28, 28' protrudes from opposite sides of the seat 8 with segments of cylindrical surfaces having the same diameter and the same axial orientation as the rolling elements 9.

Figure 4:
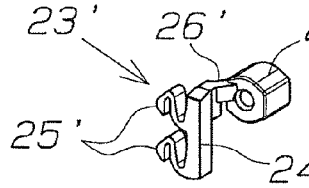
FIG. 4 shows an axonometric view of the carriage provided with the load-transmitting rolling elements and elastically yielding stops, not yet assembled.
Figure 4:
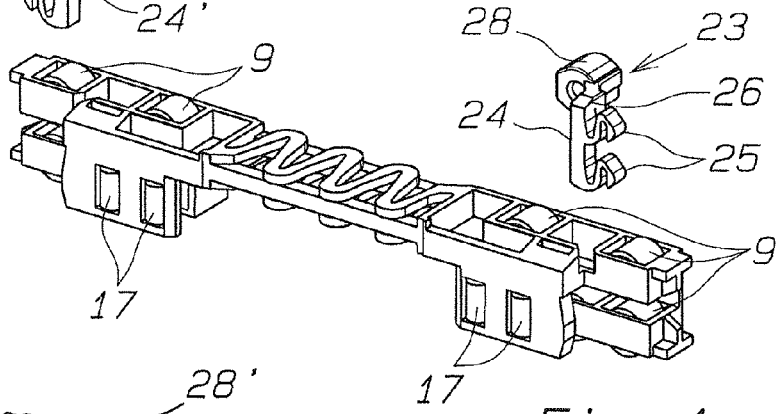
Figure 5:
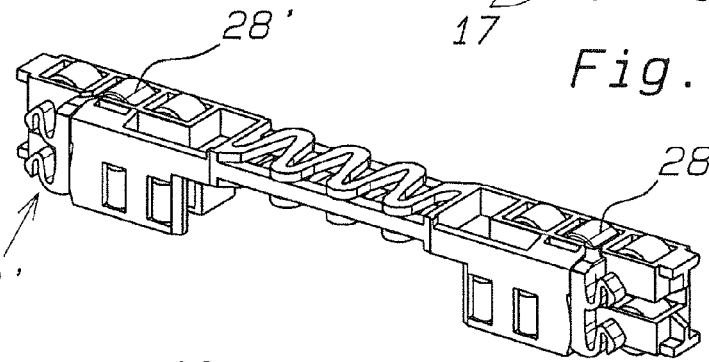
FIG. 5 shows an axonometric view of the carriage with the load-transmitting rolling elements and the elastically yielding stops, assembled.
Figure 6:
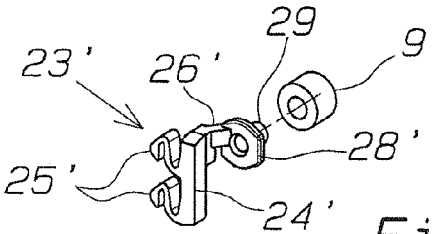
FIG. 6 shows a constructive variant of the elastically yielding stops.

The anchorage element 28 and respectively 28' of the stop 23 and respectively 23' can be formed in a single piece with the support body 24 and respectively 24' and with the bridge 26 and respectively 26', as shown in FIG. 4, or can support a pin 29 formed in a single piece with the bridge 26' and the support body 24' for housing a rolling element, as shown in FIG. 6 with reference to the rear stop 23'.

In the former case the anchorage elements 28, 28' will slide with friction over the surfaces 12, 13, 14, 15; in the latter case it will instead be possible to have rolling without sliding friction of the anchorage elements of 28, 28' on the surfaces 12, 13, 14, 15.

The elastically yielding stops 23, 23' can consist of the same material the carriage 4 is made of, or else they can be appropriately formed from a different material.

The assembly of the pull-out guide assembly for a drawer according to the invention appears clearly from what is described and illustrated and, in particular, is substantially as follows.

The rolling elements 17 are applied to the carriage 4 in all of the available seats 16 and the rolling elements 9 in all of the available seats 8 with the exception of a seat 8 at the front end 10 and a seat 8 at the back end 11 of the carriage 4.

Then the front stop 23 is applied to the carriage 4 by introducing the anchorage element 28 of the front stop 23 introduced into the seat 8, purposely left free at the front end 10 of the carriage 4, and the anchorage element 28' of the rear stop 23' into the rear seat 8 purposely left free at the back end 11 of the carriage 4.

It should be noted that the anchorage elements 28, 28' configured as said previously, in addition to anchoring the stops 23, 23' to the carriage 4, contribute to stabilizing the pull-out guide assembly since they provide points for transmission of the load between the first guide part 2 and the second guide part 3.

The pull-out guide assembly for a drawer thus conceived is susceptible of numerous modifications and variants, all falling within the scope of the inventive concept; moreover, all the details may be replaced with technically equivalent ones.

In practice, all of the materials used, as well as the dimensions, can be any whatsoever according to need and the state of the art.

The invention claimed is:

1. A pull-out guide assembly for a drawer, comprising:

a first guide part and at least a second guide part relatively and reversibly slidable in the pull-out direction of the drawer;

at least one carriage interposed between said first and said second guide part and reversibly slidable in the pull-out direction of the drawer, said carriage having a plurality of housing seats for load-transmitting rolling elements, at least one load-transmitting rolling element arranged in one of said housing seats; and elastically yielding stops at the ends of the carriage, said stops being suitable for interacting with arrest elements provided on said first and said second guide parts limit the relative sliding thereof;

wherein each of said stops is a component separate from the carriage and has means of anchorage to the carriage comprising an anchorage element insertable by means of mating shapes by force or snap fitting into at least one of the housing seats for said load-transmitting rolling elements.

2. The pull-out guide assembly for a drawer according to claim 1, wherein each of said stops has a support body which, in the assembled position, is positioned lateral to said at least one housing seat, said support body having one or more elastically yielding tabs at a front or back thereof, said support body further having bridge on a side thereof, said bridge connecting said support body to said anchorage means.

3. The pull-out guide assembly for a drawer according to claim 2, wherein said bridge extends through a slot in a wall laterally delimiting said at least one housing seat.

4. The pull-out guide assembly for a drawer according to claim 3, wherein said support body and said bridge are confined within extensions of flat outer laterally delimiting wall of the carriage in which there are provided housing seats for rolling elements for laterally guiding the relative sliding between said first and second guide part.

5. The pull-out guide assembly for a drawer according to claim 1, wherein said anchorage element is provided with one or more surfaces having a curvature analogous to that of said at least one load-transmitting rolling element.

6. The pull-out guide assembly for a drawer according to claim 5, wherein said anchorage element protrudes from opposite sides of the corresponding seat to the same degree as said at least one load-transmitting rolling element protrudes from the corresponding seat.

7. The pull-out guide assembly for a drawer according to claim 2, wherein said anchorage element is formed in a single piece with said support body and said bridge.

8. The pull-out guide assembly for a drawer according to claim 5, wherein said anchorage element supports a pin formed in a single piece with a bridge and a support body, said pin supporting a rolling element.

9. The pull-out guide assembly for a drawer according to claim 2, wherein said support body bears a first elastically yielding tab suitable for interacting with a first stop element when the drawer is brought into the extracted position, and a second elastically yielding tab suitable for interacting with a second stop element when the drawer is brought into the retracted position.

10. The pull-out guide assembly for a drawer according to claim 9, wherein said first and second tab are positioned one on top of the other.

11. The pull-out guide assembly for a drawer according to claim 9, wherein said first tab and second tab are positioned next to each other.

12. The pull-out guide assembly for a drawer according to claim 2, wherein said elastically yielding tabs are formed in a single piece with said support body.

13. The pull-out guide assembly for a drawer according to claim 2, wherein said support body is essentially a parallelepiped oriented with its longitudinal axis orthogonal to the pull-out direction of the drawer.

14. The pull-out guide assembly for a drawer according to claim 1, wherein the stops are made of a different material than the carriage.

15. The pull-out guide assembly for a drawer according to claim 1, in combination with a drawer.

16. A pull-out guide assembly for a drawer, comprising:

a first guide part and at least a second guide part relatively and reversibly slidable in the pull-out direction of the drawer;

at least one carriage interposed between said first and said second guide part and reversibly slidable in the pull-out direction of the drawer, said carriage having a plurality of housing seats for receiving load-transmitting rolling elements therein; and elastically yielding stops suitable for interacting with arrest elements provided on said first and said second guide parts to limit the relative sliding thereof;

wherein each of said elastically yielding stops is a component separate from the carriage and comprises an anchorage element insertable by engagement of mating shapes by force or snap fitting into at least one of the housing seats; and each of said elastically yielding stops has a support body which, in the assembled position, is positioned lateral to said housing seats, said support body having one or more elastically yielding tabs at a front or back thereof, said support body further having a bridge on a side thereof, said bridge connecting said support body to said anchorage element; said anchorage element formed in a single piece with said support body and said bridge.

17. A pull-out guide assembly for a drawer, comprising:

a first guide part and at least a second guide part relatively and reversibly slidable in the pull-out direction of the drawer;

at least one carriage interposed between said first and said second guide part and reversibly slidable in the pull-out direction of the drawer, said carriage having a plurality of housing seats for receiving load-transmitting rolling elements therein; and elastically yielding stops suitable for interacting with arrest elements provided on said first and said second guide parts to limit the relative sliding thereof;

wherein each of said elastically yielding stops is a component separate from the carriage and comprises an anchorage element insertable by engagement of mating shapes by force or snap fitting into at least one of the housing seats; and each of said elastically yielding stops has a support body which, in the assembled position, is positioned lateral to said housing seats, said support body having one or more elastically yielding tabs at a front or back thereof, said support body further having a bridge on a side thereof, said bridge connecting said support body to said anchorage element; and wherein said support body bears a first elastically yielding tab suitable for interacting with a first stop element when the drawer is brought into the extracted position, and a second elastically yielding tab suitable for interacting with a second stop element when the drawer is brought into the retracted position.

18. The pull-out guide assembly for a drawer according to claim 17, wherein said first and second tab are positioned one on top of the other.

19. The pull-out guide assembly for a drawer according to claim 17, wherein said first tab and second tab are positioned next to each other.

* * * * *